US010710221B2

(12) United States Patent
Koch

(10) Patent No.: US 10,710,221 B2
(45) Date of Patent: Jul. 14, 2020

(54) DEVICE AND METHOD FOR FASTENER ELEMENT RETENTION AND INSTALLATION

(71) Applicant: Kevin Scott Koch, Dubuque, IA (US)

(72) Inventor: Kevin Scott Koch, Dubuque, IA (US)

( * ) Notice: Subject to any disclaimer, the term of this patent is extended or adjusted under 35 U.S.C. 154(b) by 150 days.

(21) Appl. No.: 15/677,707

(22) Filed: Aug. 15, 2017

(65) Prior Publication Data

US 2017/0341208 A1 Nov. 30, 2017

Related U.S. Application Data

(62) Division of application No. 15/188,351, filed on Jun. 21, 2016, now Pat. No. 9,764,452.

(60) Provisional application No. 62/185,571, filed on Jun. 27, 2015.

(51) Int. Cl.

| | |
|---|---|
| ***B25B 23/12*** | (2006.01) |
| ***B25B 23/00*** | (2006.01) |
| ***B25B 23/10*** | (2006.01) |

(52) U.S. Cl.

CPC ..... *B25B 23/12* (2013.01); *B25B 23/0035* (2013.01); *B25B 23/10* (2013.01); *Y10T 29/49826* (2015.01); *Y10T 29/49833* (2015.01)

(58) Field of Classification Search

CPC ..... B25B 23/12; B25B 23/0035; B25B 23/10; Y10T 29/49833; Y10T 29/49826

See application file for complete search history.

(56) References Cited

U.S. PATENT DOCUMENTS

| | | | |
|---|---|---|---|
| 815,758 | A | 3/1906 | Starrett |
| 1,063,304 | A | 6/1913 | Titus |
| 1,644,074 | A | 10/1927 | Morgan |
| 1,754,739 | A | 4/1930 | Calvert |
| 2,235,235 | A | 3/1941 | Price |
| 2,310,287 | A | 2/1943 | Hausbeck |
| 2,327,074 | A | 8/1943 | Snyder |
| 2,519,811 | A | 8/1950 | Alexander |
| 2,579,438 | A | 12/1951 | Longfellow |
| 2,625,967 | A | 1/1953 | Stull |
| 2,641,290 | A | 6/1953 | Webb |
| 2,658,538 | A | 11/1953 | Kitterman |
| 2,762,409 | A | 9/1956 | Brasen |

(Continued)

FOREIGN PATENT DOCUMENTS

| | | |
|---|---|---|
| EP | 2265412 | 2/2016 |

*Primary Examiner* — John C Hong

(74) *Attorney, Agent, or Firm* — Simmons Perrine Moyer Bergman PLC

(57) ABSTRACT

A method and a device seek to improve productivity of the installation of fasteners. Improved productivity is targeted by holding a fastener to a driving tool with mechanical components for a substantial portion of an installation sequence to prevent nuisance disengagement between fasteners and their driving tool including dropping of fasteners early in an installation cycle. The productivity of this fastener holding approach is best realized by allowing a streamlined operation with little interaction between the device and an operator. Specifically, a fastener installation device is described which requires no direct manipulation of the device during the sequence of loading a fastener, installation of the fastener, disengagement of the device from the fastener to allow complete installation of the fastener, and loading a subsequent fastener.

10 Claims, 7 Drawing Sheets

(56) References Cited

U.S. PATENT DOCUMENTS

| | | | | |
|---|---|---|---|---|
| 2,763,304 | A | 9/1956 | Neil | |
| 2,774,401 | A | 12/1956 | Hallam | |
| 2,796,100 | A | 6/1957 | Dierker | |
| 2,840,126 | A | 6/1958 | Schmitt | |
| 2,845,968 | A | 8/1958 | Luber | |
| 2,884,971 | A | 5/1959 | Dierker | |
| 2,905,215 | A | 9/1959 | Hlynsky | |
| 2,933,114 | A | 4/1960 | Bystrom | |
| 3,012,594 | A | 12/1961 | Mangerian | |
| 3,183,956 | A * | 5/1965 | Jenkins | B29D 30/08 152/191 |
| 3,245,446 | A | 4/1966 | Morifuji | |
| 3,275,047 | A | 9/1966 | Kulman | |
| 3,298,410 | A | 1/1967 | Morifuji | |
| 3,901,298 | A | 8/1975 | Eby | |
| 3,967,664 | A | 7/1976 | Lesner et al. | |
| 4,078,593 | A | 3/1978 | Benitz | |
| 4,140,161 | A | 2/1979 | Russo et al. | |
| 4,197,886 | A | 4/1980 | MacDonald | |
| 4,236,555 | A | 12/1980 | Dewey | |
| 4,237,946 | A | 12/1980 | Leitner | |
| 4,653,358 | A | 3/1987 | Lankry | |
| 4,782,989 | A | 11/1988 | Wallin et al. | |
| 4,936,169 | A | 6/1990 | Parsons | |
| 5,207,127 | A | 5/1993 | Nick | |
| 5,341,708 | A | 8/1994 | Nick | |
| 5,470,180 | A | 11/1995 | Jore | |
| 5,509,330 | A | 4/1996 | Nick | |
| 5,791,212 | A | 8/1998 | Han | |
| 5,996,452 | A | 12/1999 | Chiang | |
| 6,082,233 | A | 7/2000 | Han | |
| 6,155,145 | A | 12/2000 | Oh et al. | |
| 6,240,811 | B1 | 6/2001 | Oesterle et al. | |
| 6,244,141 | B1 | 6/2001 | Han | |
| 6,267,026 | B1 | 7/2001 | Yamamoto | |
| 6,457,916 | B2 | 10/2002 | Wienhold | |
| 6,497,166 | B1 | 12/2002 | Fleckenstein | |
| 6,539,826 | B2 | 4/2003 | Oesterle et al. | |
| 6,668,941 | B2 | 12/2003 | Phillips et al. | |
| 6,681,662 | B2 | 1/2004 | Blackston | |
| 6,684,741 | B2 | 2/2004 | Blackston | |
| 7,124,665 | B1 | 10/2006 | Chen | |
| 7,234,376 | B2 | 6/2007 | Bader | |
| 7,249,538 | B2 | 7/2007 | Calzone | |
| 7,752,946 | B2 | 7/2010 | Wang | |
| 7,891,275 | B2 | 2/2011 | Huang | |
| 7,921,753 | B2 | 4/2011 | Chen | |
| 8,020,472 | B2 | 9/2011 | Kelly et al. | |
| 8,047,100 | B2 | 11/2011 | King | |
| 8,069,754 | B2 | 12/2011 | Elgin | |
| 8,539,865 | B1 | 9/2013 | Zimmerman | |
| 8,695,461 | B2 | 4/2014 | Moss et al. | |
| 8,893,945 | B2 | 11/2014 | Zhou | |
| 9,067,266 | B2 | 6/2015 | Puzio et al. | |
| 2002/0166421 | A1 | 11/2002 | Bowerman | |
| 2006/0278050 | A1 | 12/2006 | Hsiao | |

* cited by examiner

DEVICE AND METHOD FOR FASTENER ELEMENT RETENTION AND INSTALLATION

CROSS REFERENCE TO RELATED APPLICATIONS

This application is a divisional application of the non-provisional patent application having the serial number Ser. No. 15/188,351 filed Jun. 21, 2016; and claims the benefit of the filing date of the provisional patent application having Ser. No. 62/185,571 filed Jun. 27, 2015.

BACKGROUND OF THE INVENTION

This section provides background information related to the present disclosure which is not necessarily prior art.

Fastener elements such as a screw, nut, bolt, nail, rivet, etc., hereinafter referred to as fasteners, are used to join components together in a myriad of applications. With conventional installation tools, a fastener will engage either a drive socket for fasteners with external driving geometry, such as a hex head bolt, or the fastener will engage a drive bit for fasteners with internal driving geometry, such as a slot, cruciform or internal hex bore. Fasteners easily disengage from these conventional tools and thus an installer may steady a fastener in some fashion during the first phase of initial install until the fastener is installed to a degree its position is sufficiently maintained by the workpiece receiving said fastener. When fastening components together, the installer may need to manipulate or position those components before or while applying a fastener. It is not uncommon to see fasteners loosely applied by hand without any drive tools, prior to using such tools, since the conventional drive tools do not hold a fastener firmly enough to allow the installer to perform such manipulation after loading the fastener into or onto an installation tool.

For both fasteners with internal and external drive geometry, a fastener is engaged with the drive device by axially positioning the fastener into or around the drive device, after which point it is held there with a limited amount of friction. Multiple devices have improved upon the original state of concerns and may restrain a fastener from disengagement under the force of gravity and modest kinematics from the operator positioning the tool with the fastener loaded for install. The currently known approaches have features or operational requirements which may hinder productivity during their use. The following paragraphs discuss categorical approaches of the most relevant known prior art.

A first method employs one or more magnets to impart an axial pull on the fastener, urging it towards the drive mechanism, which may be done by fixing a magnet inside of a drive bore, or for internal drive geometries, the bit itself could be magnetized or a magnetic collar could be disposed around a drive bit so as to contact the face of the fastener directly. Designs with a magnet disposed around a drive bit are depicted in U.S. Pat. Nos. 2,641,290 and 7,124,665 (and are commercially available under several brands as of May 2015 including the Hammerhead model HAIB06.) Magnetic drivers have been available for use with drill drivers and other power tools. The drivers are used for driving fasteners, e.g., nuts and screws having a polygonal-shaped, e.g., hex-shaped head. This magnet may interfere with or complicate the loading process by pulling the fastener against the driving tool in an undesired orientation and alignment. Also a magnet may attract metal debris which can interfere with the intended usage of such drive devices. U.S. Pat. No. 8,695,461 provides a fastener holding magnet which can be slid forward in the driving assembly for easier cleaning of the magnet in order to reduce the issues caused by attracting debris, however this modification also increases the difficulty and awkwardness of fastener loading. With this approach, the ability of the fastener retaining mechanism to resist forces normal to the fastener and tool axis, or moments about any axis other than the drive axis, is limited and there is limited ability to prevent disengagement from mechanical procession under such loads. The axial holding force of the magnet is also limited.

A second type of approach employs a drive bit for internal fastener drive geometry, which expands inside that fastener's drive geometry to create retention force. This arrangement could reduce the strength of the drive bit so it may be best used for starting a fastener or installing fasteners which require limited install torque, thus such a mechanism may not be suited for use with a powered driver. Further, these devices often require manual actuation, which may consume time and thus may limit productivity of a user. The fastener retaining means of this approach may be limited. U.S. Pat. Nos. 1,063,304, 4,078,593, and 6,681,662 disclose varying approaches to this general concept.

A third approach employs multiple holding members comprised of a leaf spring, with some geometry on the end of said leaf spring to apply force to the underside of the fastener head in a radially inward and axial direction, urging the fastener against the drive mechanism. The leaf spring elements themselves may be fragile due to their required flexible nature and thus may not be well suited for use with a power driver or high volume applications. These tools may only seek to restrain the screw from disengaging under the force of gravity and the kinematics of the operator positioning the tool with the fastener loaded for install. This approach will often have a limited ability to retain fasteners. Further, the leaf springs may require additional operator intervention during the loading sequence, possibly during the installation sequence depending on the application and the feature geometry. Examples of this approach are disclosed in U.S. Pat. Nos. 815,758, 2,519,811 and 2,762,409.

A fourth type of approach employs jaws which pinch around the fastener to assist with maintaining axial alignment, longitudinal position or both. This is similar to the third approach; however the fastener holders with this approach may be shaped differently and actuated in a variety of manners. While this design approach may allow more robust constructions than the leaf spring approach, it may also contain many of the same drawbacks. One example of this approach is depicted in U.S. Pat. No. 4,236,555. The amount of force that can be exerted by these retaining means may be limited, so undesirable angular misalignment of the fastener from the driving axis may occur in operation. In order to load this device, a fastener is dropped into a loading tube, 24 in the Figures. If gravity causes the fastener to drop down into the loading tube and then travel into the main bore of the tool, such a tool may only be suited for installing fasteners in a largely vertical direction. U.S. Pat. No. 6,244,141 discloses another approach to this design where the retention members ("clamps") 150 and 151 are urged radially inwards by an outer sleeve 160 in order for these members to engage against the bottom surface of the screw head and hold the screw against the drive bit (102). With this design, the fastener is first located properly relative to the sleeve and then the outer sleeve 160 may need to be manually positioned during the loading sequence. Since this tool is intended to be held in either a hand or power tool, either of which could be held in one of a user's hands during operation, in order to prevent a fastener from falling off the tool, it may need to be turned into a largely vertical, upside down fashion with the bit pointing up such that the fastener does not fall off the driving device when the user loads the screw with a second hand and then releases that screw to use the same second hand to position the sleeve 160. U.S. Pat. No. 6,539,826 discloses a device used for driving screws with specially formed heads in which jaws 3 and 4 have connected features 19, 20 for engaging with and transmitting torque to drive geometry 13 on the screw head. When a user loads a screw, they supply force to the screw to position components 30, 3, and 4 during which the frictional retention of those components must be overcome, including the position retaining force created by spring loaded pin 36 engaging groove 34. Jaws 3 and 4 are forced radially inward by means of a bore in holder 2 to capture a screw head. After full installation of the screw, the tool may then be pulled away from the screw, releasing it in the process. U.S. Pat. No. 3,901,298 discloses another similar approach in which a user may manually position a sleeve against the force of a spring to hold fastener retention jaws in an open position while loading a fastener. A user holding the driving tool, while also pushing sleeve 52 forward and loading a fastener, may be an awkward task. Further, the sleeve is pushed forward at some point in the installation sequence to release the jaws from the fastener to allow for complete installation without obstruction from the fastener retaining components. User intervention during loading and release of a fastener may limit productivity.

A fifth approach employs a plurality of radially traveling segments in a collet type arrangement that can be radially expanded or compressed through a variety of mechanical means. This may put pressure directly on a fastener to clamp it, or it may close around the fastener and geometrically prevent unintended removal by means of a relief slot in the fastener-engaging side of the movable segments. U.S. Pat. No. 6,497,166 discloses such an approach where a collet 40 includes prongs 24 with an internal groove 62 used to hold the head of a screw. The prongs 24 are such that they may surround a screw head 38 without grippingly engaging it until biased inwardly. To clamp the screw, an operator slides sleeve 22 forward, towards the screw being loaded. During installation, the sleeve 22 will contact a work surface and travel rearward, thereby opening the prongs 24 and releasing the screw. Thus a user of this tool may need to manually position the sleeve 22 after loading a fastener. To operate, a user may need to hold the driver, place a fastener, and then hold the fastener while sliding the sleeve 22 forward. This intervention may limit productivity. U.S. Pat. No. 2,658,538 describes a similar approach. In this arrangement, a user may need to manually retract the sleeve ("housing") 44 in order to load a screw. In operation of this device, the screw is released from the device automatically based on item 50 contacting the work surface and retracting the sleeve 44 without additional intervention from the user. Manual intervention of the tool while loading may limit productivity.

A sixth approach is to have a sleeve slidably disposed about the shank of a driving tool, including a flange capping the end of said sleeve wherein said capping flange has a reduced cross-sectional opening which is too small to permit axial passage of a fastener. A fastener can be loaded into such a holder by passing laterally through a radial slot in the sleeve so that the head of the fastener can be urged against a driving bit or socket by force exerted by this capping flange, said force typically coming from a spring. After substantially installing the fastener into the workpiece, the sleeve may be slid slightly forward in order to allow clearance between the driving tool and the fastener head. The driving tool is then moved laterally past the fastener where the head of said fastener will pass through the aforementioned slot in the sleeve. The sleeve can then be freely retracted such that a driving bit can protrude sufficiently past the capping flange of the sleeve to complete full installation of the fastener. This approach is depicted in U.S. Pat. No. 2,796,100 where the head 14 has a slot 18 in the end and a capping flange 19 has a slot 20 to permit engaging and disengaging a fastener 9 with the driver 1. In this case, the sleeve assembly 8 ("holding means") is positioned longitudinally and held by use of a cam sleeve 30. Similar approaches which utilize varying mechanics and operational procedures can be seen in U.S. Pat. Nos. 2,774,401, 2,884,971, and 8,539,865. Screw-holding screwdrivers employing this approach, and utilizing a simple spring to continuously urge the retaining sleeve in a rearward direction, are commercially available under the Greenlee brand at the time of this application, such as item #0453-18C for driving #2 Phillips bits and other models for other head types. The approach of this category may be best suited for applications where the amount of time spent loading a fastener is of secondary importance. User intervention to load the fastener, as well as to disengage the driver part-way through the fastener installation, may make use with a power driver impractical and this manipulation may limit productivity.

A seventh approach provides a sleeve into which an entire fastener can be slid for rough guidance. This approach provides axial guidance, though possibly in a limited sense, as the full bore of the sleeve must be greater than the diameter of the head and the leading point of the fastener is often significantly smaller. It is thus possible for a fastener to be located within such a sleeve with angular misalignment from a drive bit or socket, such as having the fastener head roughly centered below the driving bit or socket and the fastener shank bearing against the inner wall of the sleeve near the distal end where the device makes contact with the work surface. Thus this approach may not be appropriate for fasteners which require precise axial alignment. Further, as coaxial misalignment between a fastener and mating bit or socket increases, the ability to transmit drive torque and prevent disengagement of the two may be limited. This general type of fastener driving device is depicted in U.S. Pat. No. 1,644,074 and products commercially available since at least 2003, for example, what is currently marketed at the time of this application under Dewalt part number DW2055, Bosch part number CC60491 and many others. In operation of the aforementioned commercially available driving devices, the retaining sleeve may need to be repositioned between each fastener installation, pulling the outer sleeve forward since it is pushed rearward whenever a fastener is installed. This user intervention may limit productivity. U.S. Pat. No. 6,668,941 proposes an improvement to this device wherein the outer sleeve is spring-loaded to automatically return its forward-most position without additional user intervention, thus theoretically reducing time to manually position the sleeve.

An eighth approach utilizes a plurality of drive sections stacked axially upon each other, which can have a torsional force applied between them for purpose of retaining a fastener by various types of drive geometry. U.S. Pat. No. 8,020,472 discloses one such device ("nut capturing socket assembly") 20, which utilizes a sleeve 24 with generally the same drive geometry as a main drive socket 22, but is torsionally disposed about that main drive socket. A user may need to rotate this sleeve 24 to align the drive geometry with that of socket 22, at which point a fastener may be loaded. The operator may release the device after loading the fastener and the relative torsion between the socket 22 and the sleeve 24 will create friction on the outer surface of the fastener to resist dropping of the fastener. The process of manipulating the driving device 20 while loading the fastener may be somewhat awkward with a user holding either the socket 22 or the shank that will provide driving rotation to this device, while also rotating sleeve 24 and loading a fastener. Further, the amount of retaining force possible may be directly related to the torque applied by the torsion creating means which, for purpose of tolerable user actuation, may be relatively small. Holding force applied to the fastener could thus be limited in this approach. Manipulation of the tool may limit productivity.

A ninth approach uses a resilient member such as a spring to urge retaining elements radially inward to capture the underside of a fastener head. This may be done by having a resilient member pushing directly on retaining elements, such as in U.S. Pat. No. 2,235,235, or it may be done indirectly by a spring urging a cam sleeve, which in turn urges retaining elements radially inward, such as in U.S. Pat. No. 5,996,452. It should be noted in each of these patents, the spring force which urges the retaining elements radially inward may need to be overcome by a user when loading a fastener. A correlation may exist between the force available to retain a fastener against external forces and the force required to overcome the resilient force urging the retaining elements radially inward when loading a fastener. The time spent loading such a device and the screw retention capacity of this approach may limit productivity.

A tenth approach, somewhat similar to the ninth approach, is designed such that a cam sleeve will pass the retaining elements in such a manner that the resilient member (usually a spring) is used merely to position the sleeve, not to directly or indirectly provide the holding force. In this fashion, once the components are positioned, something else must reposition them to allow the retaining elements to release the fastener. During installation that allows very high forces to be exerted by the retaining elements, and thus the driving tool may resist a high level of axial force, and prevent disengagement due to force perpendicular to the fastener axis and moment forces between the driver and the fastener. U.S. Pat. No. 5,341,708 details once such embodiment of this approach. In this patent, a body 41 is locked upon a drive bit 21. A body member 71 is urged forward relative to body 41 by a spring 60. Member 71 has multiple apertures 93 located at the forward end in which a plurality of ball bearing retaining jaws 111 are carried. A cam sleeve 131 is biased forward relative to body member 71 by a second spring 90. Cam sleeve 131 has a pair of bores, 141 which is slightly larger than the diameter of body 71 and bore 142 which is a larger diameter and located at the forward end of sleeve 131.

When bore 142 is substantially aligned with retaining jaws 111, they can be retracted in the apertures 93 so as not to restrict the loading and unloading of a fastener 30. However, when sleeve 131 is in its forward position, the smaller bore 141 will be substantially aligned with apertures 93, thus forcing the retaining jaws 111 radially inward towards the tool's central axis, whereby passage of a screw head past the balls to load or unload a screw is prevented.

When no screw is loaded, body 71 and sleeve 131 will be at their forward-most position with retaining jaws 111 protruding into the bore of body 71, thus preventing a screw from being loaded until sleeve 131 is pulled rearward by a user. At that point, a screw 30 can be positioned on bit 21 and sleeve 131 can be released. Sleeve 131 will travel forward; thereby pushing retaining jaws 111 into the central bore of body 71, obstructing said bore enough to prevent removal of the screw.

Since the bore 142 passes the center of retaining jaws 111, outward force on the retaining jaws created by any attempt to remove the screw may not cause sleeve 131 to move rearward, thus the screw is mechanically locked in the loaded position. This feature distinguishes devices of this category from the prior ninth category presented. As a screw is being installed, sleeve 131 will contact a work surface and it will be retracted to release the screw to allow for full fastener installation without manual manipulation after driving has begun. A user manipulating sleeve 131 in order to load a screw may be an awkward task considering the user may need to concurrently hold or steady the driving tool such as a drill, retract sleeve 131 and load the screw. The time spent for this manipulation, while loading, may limit productivity.

U.S. Pat. Nos. 4,140,161 and 5,207,127 and US Patent application 20020166421 utilize similar mechanical components, which require direct manual manipulation of the screw retaining components by a user during the loading sequence. U.S. Pat. No. 6,155,145 discloses a similar approach in which a cam sleeve 400 is positioned by a user. Further, while a user would be loading a screw ("nail") into the device, they may be required to oppose the force of a compression spring 610 for a significant travel distance. Since this spring is providing the retention force, it is likely stiff. Thus the loading sequence may pose challenges to a user who may need to concurrently steady the tool, exert significant thrust on a sharp fastener, and manually position cam sleeve 400.

U.S. Pat. No. 4,197,886 describes another device where a user may load a screw without touching or directly manipulating the components of the device, however while loading a fastener, the user is exerting force to position the retaining elements, namely retaining balls 94, their carrier sleeve 84 and a spring 88, which urges those elements forward, whereby the act of loading the fastener will temporarily store energy in spring 88 prior to reaching a triggering point where that energy is released and sleeve 84 is pushed forward, in turn causing balls 94 to be pushed radially inward through contact with cam surface 98. The effort exerted to position the screw retaining components of the device of this invention may limit productivity.

The screw retaining means of U.S. Pat. Nos. 4,197,886 and 5,996,452 are similar; however the diagrams of the later patent depict a flat head fastener with a tapered surface under the head. Since the taper angle is closer to the central axis of the tool than the inclined surface 104 which urges the retaining balls inward, the retaining force of that particular configuration may be directly related to the force exerted by the spring and therefore U.S. Pat. No. 5,996,452 was listed in the prior category. As the categories are defined in this background discussion, each could qualify for both categories depending on the screw head geometry which is selected.

U.S. Pat. No. 6,457,916 describes a prior art device of interest. This patent describes a device for receiving conventional tool shanks such as those conforming to ANSI B 107.4-1982. Thus this device is designed to receive a shank of length significantly greater than cross-sectional width which has a consistent geometrical outer profile aside from a circumferential detent groove to which significant thrust may be imparted between the device and said shank in both directions along the central axis of the device. Also of particular interest is the device described in this patent requires direct manipulation of an outer cam sleeve 14 during the unload cycle.

In operation, a user may directly manipulate outer cam sleeve 14 to a first position and release, subsequently allowing an appropriate tool bit 40 to be pushed into a bore 36 of device 10 where the device will cycle to a closed position without requiring direct manipulation of said sleeve 14 while the bit 40 is being loaded. While cycling between the unloaded and loaded configurations, sleeve 14 travels to a second position, whereby the geometry of that cam sleeve locks the installed bit 40 within the bore 36 of device 10 by means of a bit detent ball 16 protruding radially inward into bore 36 and a circumferential groove 44 in the shank of bit 40. To release the bit, a user directly manipulates cam sleeve 14 from its second position where the bit is held by bit ball 16 to its first position where bit 40 can be removed. The user may then release cam sleeve 14 and then directly grasp bit 40 to remove it from device 10. A subsequent bit 40 can then be loaded into device 10 without direct manipulation of the device while the bit is being loaded. The device described in this patent requires direct manipulation to position the cam sleeve 14 whenever a bit is to be unloaded and it contains no provisions to describe, suggest, car motivate any deviation from that style of operation nor does it illustrate or suggest any mechanics which would enable other operational procedures.

SUMMARY OF THE INVENTION

A method and a device are disclosed which seek to improve productivity of the installation of various fasteners. This improved productivity may be achieved by allowing a fastener to be loaded into a device as is shown in the descriptions to follow such that no direct manipulation of said device is required during the loading of a fastener, the installation of that fastener, the disengagement of said device from the installed fastener, or before loading a subsequent fastener.

It is a further object of the present invention to utilize a mechanical means of holding fasteners securely, such that a fastener loaded into a device as depicted in the descriptions below will resist significant axial and bending moment forces about any axis without becoming disengaged from the said device during the initial phase of fastener installation to enhance productive installation of fasteners of all types.

It is a further object of the invention to provide a means by which thrust may be transmitted directly from a driving tool connected to a device of the present invention, through said device and to a fastener without the thrust force applied to the fastener being transmitted through a spring to increase the thrust transmission ability.

It is a further object of one embodiment of this invention to provide a means of assisting with proper alignment of two adjoining fasteners for more productive assembly without requiring fastener features, such as a dog-point. Many basic fasteners do not have such a point to facilitate such alignment, and typically adding such a feature adds cost to fasteners and it may further add undesirable length to that fastener.

It is a further object of one embodiment of this invention to provide a clutch mechanism for disengaging transmission of torque to a fastener at an adjustable depth for quick and consistent fastener installation.

It is another object of the present invention that one or more stages of stored energy will be released while loading a fastener to position fastener retention elements as needed where this energy has been previously stored and thus this energy need not be supplied while a fastener is being loaded into the device.

Furthermore, in some fastening applications, such as installation of drill-point and other self-drilling screws, a significant amount of thrust must be applied to the fastener while it is being driven, typically by a rotary tool. Generally, that fastener will be driven numerous rotations prior to engaging the work sufficiently that buckling between a fastener and the driver is no longer a concern. Further, these screws are commonly installed in large volumes during construction activities. They thus represent particularly demanding applications where the limitations of current methods are amplified and the benefits of the present invention are highly impactful.

The device of the present invention can be coupled to or integrated with many types of conventional driving tools for applying thrust and rotational force to the device. These driving tools include, but are not limited to, an impact driver, drill, screw gun, and a manually powered screw driver.

The method described can further include use of such tools. It should be noted that the term "direct manipulation" as has been used previously and will be used subsequently refer to a user, machine, mechanism etc. other than a driving tool, fastener, or a work surface contacting the device to position or manipulate components. In many cases of installing a fastener, it is required to apply thrust and/or rotational torque to that fastener and thus thrust and rotational torque may also need to be applied to the shank of the device of the present invention where and as necessary, however these are considered "indirect manipulation" since a user will typically not need to directly touch the device of this invention while applying said thrust and rotational torque.

One illustrative application would include the device of this invention installed in a drill where a user's first hand is always holding onto said drill by the handle as it will be held during typical drilling and driving operations; said user's second hand being used only to load a fastener into said device as needed by orienting and pushing said fastener or fasteners into said device. The user's second (fastener loading) hand would not typically need to touch the device while multiple sequential fasteners are installed.

The device of the present invention can also be utilized to remove fasteners and it provides unique benefits to such. When removing a fastener, a user would begin with the device in the open configuration, precisely the same configuration the device is in before a fastener is loaded prior to install. As the fastener is backed out from its installed position, the device and fastener will go through the same configurations of the device shown for installation, but in the reverse order. A benefit to the removal of a fastener is that significant thrust can be applied to the fastener in the direction pointing away from the work surface the fastener is installed in. This is of significant benefit for removing drill-point screws where the screw threads disrupt the fastener receiving material after the drill point creates a hole, causing the clear passage diameter of the fastener's hole to be smaller than the drill tip. Removal of these screws may thus require significant rearward thrust, often supplied by a pliers or similar tool. After removing a fastener in this sort of arrangement, the outer cam sleeve will need to be pulled away from the distal end of the tool to release the fastener.

These together with additional objects, features and advantages of the fastener retaining and installation device and method will be readily apparent to those of ordinary skill in the art upon reading the following detailed description of presently preferred, but nonetheless illustrative, embodiments of the fastener retaining and installation device and method when taken in conjunction with the accompanying drawings.

In this respect, before explaining the current embodiments of the fastener retaining and installation device and method in detail, it is to be understood that the fastener retaining and installation device and method is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fastener retaining and installation device and method.

It is therefore important that the claims be regarded as including such equivalent construction insofar as they do not depart from the spirit and scope of the fastener retaining and installation device and method. It is also to be understood that the phraseology and terminology employed herein are for purposes of description and should not be regarded as limiting.

DETAILED DESCRIPTION

LIST OF FIGURE NUMERALS

Figure 1:
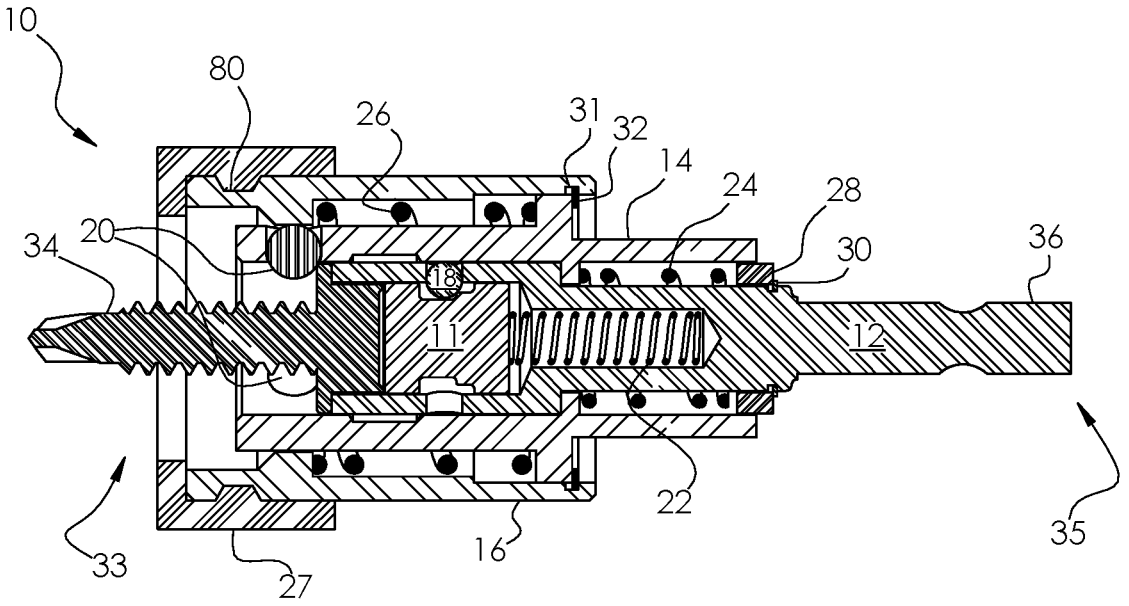
FIG. 1 is a section view of a first embodiment with a fastener in the loaded position.

The following table lists a description of the numerals used to annotate figures in this application.

10 A first embodiment of the present invention
11 Trigger shuttle
12 Driving bit
13 Distal face of bit 12
14 carrier sleeve
16 Cam sleeve
18 Trigger ball
20 Retention balls
21 Radial passages for retention balls
22 Trigger shuttle spring
24 Carrier sleeve spring
26 Cam sleeve spring
27 Bumper
28 Washer
30 Retaining device
31 Internal circumferential groove
32 Retaining device
33 Forward distal end
34 Fastener
35 Driven proximal end
36 Hexagonally shaped quick-change shank
37 Top washer surface of fastener 34
38 Intermediate section of driving bit
40 Front section of driving bit
42 Circumferential groove for retaining device
44 Shoulder formed between the front and intermediate sections
46 Radial passage for trigger detent ball
48 Formed geometrical profile for torsionally engaging a fastener head
54 Longitudinal bore of first diameter (in distal end of driving bit 12)
56 Longitudinal bore of a second smaller diameter
60 section of trigger shuttle of a first outer diameter
62 section of trigger shuttle of a second diameter, less than the diameter of 60
63 shoulder in trigger shuttle formed between sections 62 and 64.
64 section of trigger shuttle of a third diameter smaller than section 62
66 Shoulder formed between sections 60 and 62
70 Internal circumferential groove (in sleeve 14, for the triggering ball)
71 Internal collar of sleeve 14
72 shoulder (at proximal end of circumferential groove 70)
73 External collar of sleeve 14
74 Front section of jaw retaining sleeve 14
76 Internal collar of cam sleeve 16
78 Distal shoulder of internal collar 76
80 Groove in sleeve 16 to receive a scratch resisting bumper
82 Distal face of sleeve 16
100 Work Piece 1
102 Work Piece 2
104 Work surface
106 Power Drill
120 Trigger shuttle
121 Central bore in trigger shuttle
122 Drive bit
123 Radial passage for retaining jaws
124 Sleeve spring
126 Cam sleeve
128 Trigger balls
130 Radial passage for trigger balls
132 Nut
134 Bolt
136 Driver engaging depression
138 A second embodiment of the present invention

140 Washer
142 Retaining device
144 Internal circumferential groove in cam sleeve 126
146 Longitudinal threaded bore
148 Set screw
160 A fourth embodiment of the present invention
161 Fastener
162 Bit holder
164 Bit insert
166 Carrier sleeve
168 Cam sleeve
170 Spring retainer sleeve
172 Adjustable ring
174 Jam nut
176 Retention balls
178 Clutch balls
180 Spacer ball
182 Intermediate ball
184 Trigger balls
186 Retaining ring
188 Retaining ring
190 Set screw
192 Face (of sleeve 168)
194 Face (of sleeve 166)
196 Face (of sleeve 166)
198 Face (of spring retainer sleeve 170)
200 Internal groove (on carrier sleeve 166 for triggering)
202 Internal groove (on carrier sleeve 166 for clutch)
204 Shoulder
206 Bore face
208 Workpiece
210 Circumferential groove Now referring to the figures and to the associated descriptive text below, wherein like numbers refer to like matter throughout.

FIG. 1 is a cross-sectional view of a first embodiment with a fastener in the loaded position. For clarity, this figure focuses primarily on identifying the individual components of the assembly, not features of the components. The device for retaining and driving fasteners of a first embodiment is illustrated generally as 10. The assembly includes a trigger shuttle 11, a driving bit 12, a carrier sleeve 14, a cam sleeve 16, a trigger ball 18, a plurality of radially spaced retention balls 20, a trigger shuttle spring 22, a carrier sleeve spring 24, a cam sleeve spring 26, a washer 28, a retaining device 30, a retaining device 32 disposed in circumferential groove 31 and a fastener 34. The assembly has a forward distal end 33 and a driven proximal end 35. The driven end of drive bit 12 is formed with a shank 36 to be received by a common drive device, such as an impact driver, drill, screw gun, or screw driver. This shank 36 is shown as a standard quick change design. A scratch resistant bumper 27 is optionally included to reduce the likelihood of scratching a work surface receiving fastener 34. Bumper 27 is held in a circumferential groove 80 in sleeve 16.

Figure 2:
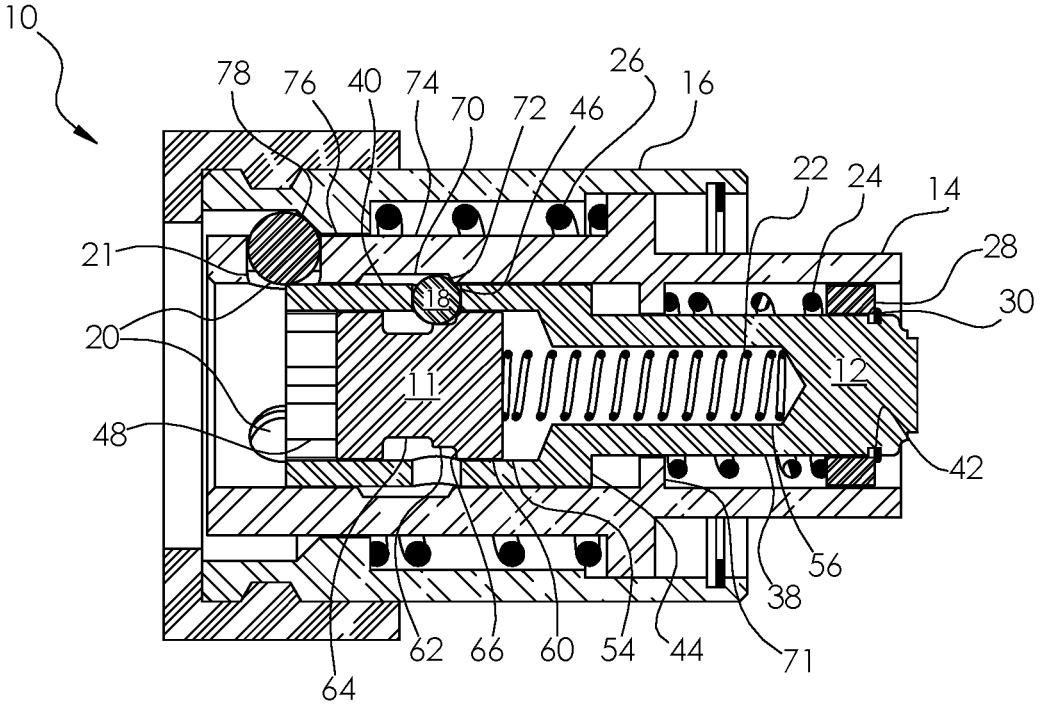
FIG. 2 is a section view of a first embodiment in the unloaded position, ready for a fastener to be loaded

FIG. 2 is a cross-sectional view of a first embodiment illustrated generally as 10, configured in the unloaded position, ready for a fastener to be loaded. In this figure, previously shown shank 36 has been cropped off the proximal side of the device as it may take the form of many conventional shank styles, the specifics of which are not central to the function of this embodiment. The distal end of drive bit 12 has a bore 48 for receiving the external drive geometry of a fastener. The trigger shuttle 11 is slidably located in a longitudinal bore 54 within bit 12. The trigger shuttle 11 has a proximal section 60 of a first outer diameter which is slightly smaller than the diameter of bore 54 to allow relative sliding motion between trigger shuttle 11 and bit 12. Shuttle 11 includes a section 62 of a second diameter distal to section 60 and also of a smaller diameter than 60. A third section 64 is distal to section 62 and section 64 has a diameter which is smaller than section 62. Trigger shuttle 11 has a circumferential shoulder 66 between sections 60 and 62. A trigger detent ball 18 is located in a radial passage 46 within bit 12. A shuttle spring 22 located largely in bore 56 of bit 12 reacts between bit 12 and shuttle 11.

In the unloaded configuration of device 10, generally depicted by this figure, the trigger detent ball 18 is restricted against radial travel towards the center axis of the device by shuttle 11. Detent ball 18 protrudes past the outer surface of the front section of the driving bit, 40 and protrudes into the internal groove 70 of sleeve 14. The proximal shoulder 72 of groove 70 will be in contact with trigger ball 18 due to spring 24 reacting between bit 12 and sleeve 14 with assistance from an internal collar 71 within sleeve 14, washer 28, and retaining device 30 installed in a circumferential groove 42 of bit 12. This configuration limits the forward position of sleeve 14 relative to bit 12. The forward position of shuttle 11 is limited by shoulder 66 bearing against ball 18. A plurality of balls 20, shown here as spherical members, are disposed in radial bores 21 and are limited from traveling radially inward towards the center axis of the tool by contact with the front section 40 of driving bit 12 so as to leave the device unobstructed for the loading of a fastener. Balls 20 protrude past the outer surface of the front section 74 of sleeve 14. By balls 20 protruding past the outer surface of section 74 and contacting a distal shoulder 78 of internal collar 76 in sleeve 16, the balls 20 will limit the forward position of sleeve 16 relative to sleeve 14 while spring 26 reacts between sleeve 14 and sleeve 16, thus urging sleeve 16 forward. Bit 12 has an intermediate section 38 of smaller diameter than the front section 40, thus forming a shoulder 44 between those sections. Further, the internal collar 71 within sleeve 14 has a bore slightly larger than the diameter of intermediate section 38 to allow relative longitudinal motion. In this configuration of device 10, there is a gap between shoulder 44 and internal collar 71.

Figure 3:
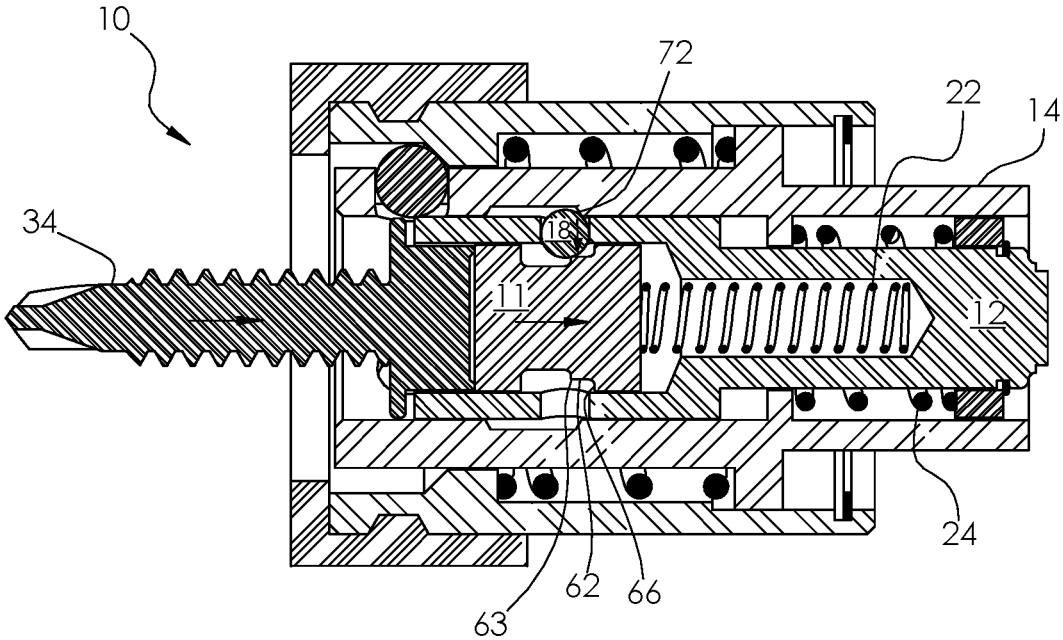
FIG. 3 is a section view of a first embodiment where a fastener is being loaded, near the point that the system will trigger to the loaded position

FIG. 3 is a cross-sectional view of a first embodiment where a fastener has been partially loaded into device 10 after it was in the state shown in FIG. 2. Arrows have been superimposed on various bodies to indicate the direction they have moved since the preceding state illustrated in FIG. 2, where for purpose of illustration bit 12 is assumed to be the fixed reference frame.

At this stage, device 10 is near the point that it will trigger to the loaded position where fastener 34 will become retained in device 10. Fastener 34, which is depicted as a hex washer head screw, has been inserted into driver bit 12 and has pushed trigger shuttle 11 some distance toward the driven proximal end of the device, whereby spring 22 is further compressed. Ball 18 has traveled radially inward from its prior position due to contact with shoulder 72 on sleeve 14 under the force of spring 24. Ball 18 is no longer in contact with shoulder 66, and ball 18 has now started to travel radially inward past the surface of section 62 of trigger shuttle 11. Ball 18 is bearing against circumferential shoulder 63 to resolve the vertical forces exerted by sleeve 14 under the force of spring 24.

Figure 4:
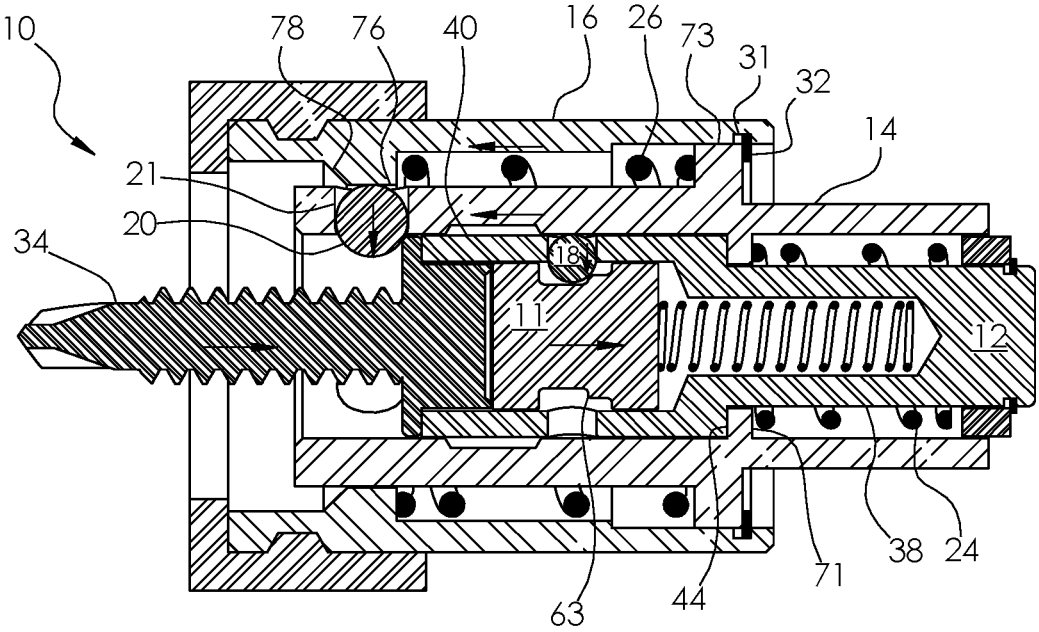
FIG. 4 is a section view of a first embodiment where a fastener has been fully loaded and is ready to be installed

FIG. 4 is a cross-sectional view of a first embodiment where a fastener has been fully loaded into device 10 and is ready to be installed in a workpiece. Arrows have been superimposed on various bodies to indicate the direction they have moved since the preceding state illustrated in FIG. 3, where, for purpose of illustration, bit 12 is assumed to be the fixed reference frame.

Between FIG. 3 and FIG. 4, fastener 34 was pushed further rearward into bit 12, moving shuttle 11 rearward allowing ball 18 to fully bypass shoulder 63. With ball 18 in this position, it no longer protrudes past the outer surface of section 40 of bit 12 and therefore no longer limits the longitudinal position of sleeve 14, which thus has traveled forward under the force of spring 24 until shoulder 44 of bit 12 contacted internal collar 71 of sleeve 14. In this position, balls 20 are freely able to travel inward in their respective bores 21, said bores which are shaped so as to prevent the balls from fully passing inwards through and out of said bores should a device be manipulated to such a position without a fastener installed. Balls 20 will be forcefully pushed radially inwards in radially spaced bores 21 by sleeve 16 traveling forward during the triggering cycle given the force of spring 26 pushing sleeve 16 forward whereby circumferential shoulder 78 bears against balls 20 while sleeve 16 travels forward relative to sleeve 14. Once the internal collar 76 bypasses balls 20, the inner surface of collar 76 will prevent travel of balls 20 radially outward, thus mechanically locking fastener 34 into device 10. There is a minimal clearance between balls 20 and the fastener 34 to maintain alignment of device 10 and fastener 34 to be largely coaxial. The forward position of sleeve 16 is limited relative to sleeve 14 by contact between external collar 73 on sleeve 14 and a retaining device 32, which is held in an internal circumferential groove 31 in sleeve 16. It should be noted that an intermediate section 38 of driver bit 12 is sized to be longitudinally slidable within the central bore of internal collar 71 in sleeve 14.

Figure 5:
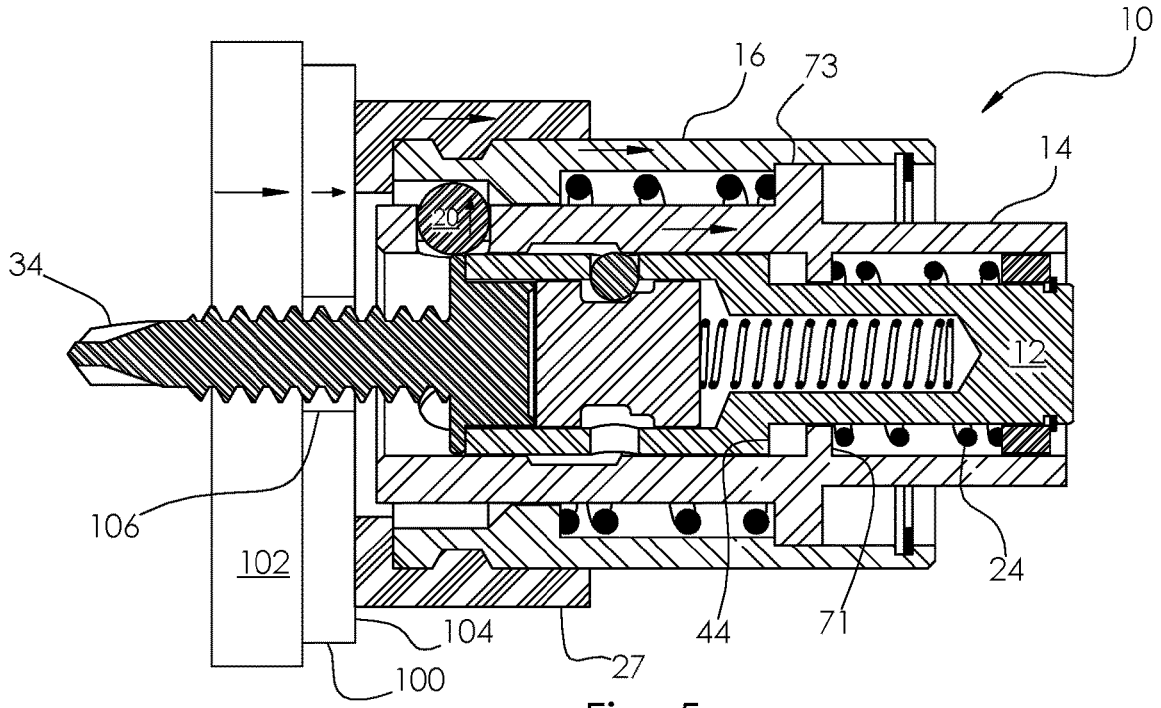
FIG. 5 is a section view of a first embodiment where a fastener is being installed in a work piece

FIG. 5 is a cross-sectional view of a first embodiment where a fastener 34 is being installed using device 10. Arrows have been superimposed on various bodies to indicate the direction they have moved since the preceding state illustrated in FIG. 4, where for purpose of illustration bit 12 is assumed to be the fixed reference frame.

In this diagram, fastener 34 is depicted as a self drilling hex washer head screw and a first workpiece 100 is shown containing a hole 106 prior to the installation of fastener 34. A second workpiece 102 is shown with the fastener 34 protruding through it after the drill point on fastener 34 drilled through it as is typical for screws of this nature. In this diagram, fastener 34 is only partially installed as can be seen from the distance between the exterior work surface 104 of workpiece 100 and the underside of the head on fastener 34. By thrust being applied to device 10 during the install process while fastener 34 progresses forward, bumper 27 has contacted work surface 104 and has been retracted proximally along with sleeve 16. Sleeve 14 is limited against further travel forward due to contact between collar 73 with an internal shoulder in sleeve 16. In this position of sleeve 16 relative to sleeve 14, sleeve 16 no longer limits the outward radial travel of balls 20 such that further the progression of fastener 34 forward relative to sleeve 14 has pushed balls 20 radially outward. From this state, further installation of fastener 34 will cause bit 12 to progress forward relative to sleeve 14 such that the gap between shoulder 44 and collar 71 continues to grow while further compressing spring 24 in the process until the point fastener 34 has been fully installed.

Figure 6:
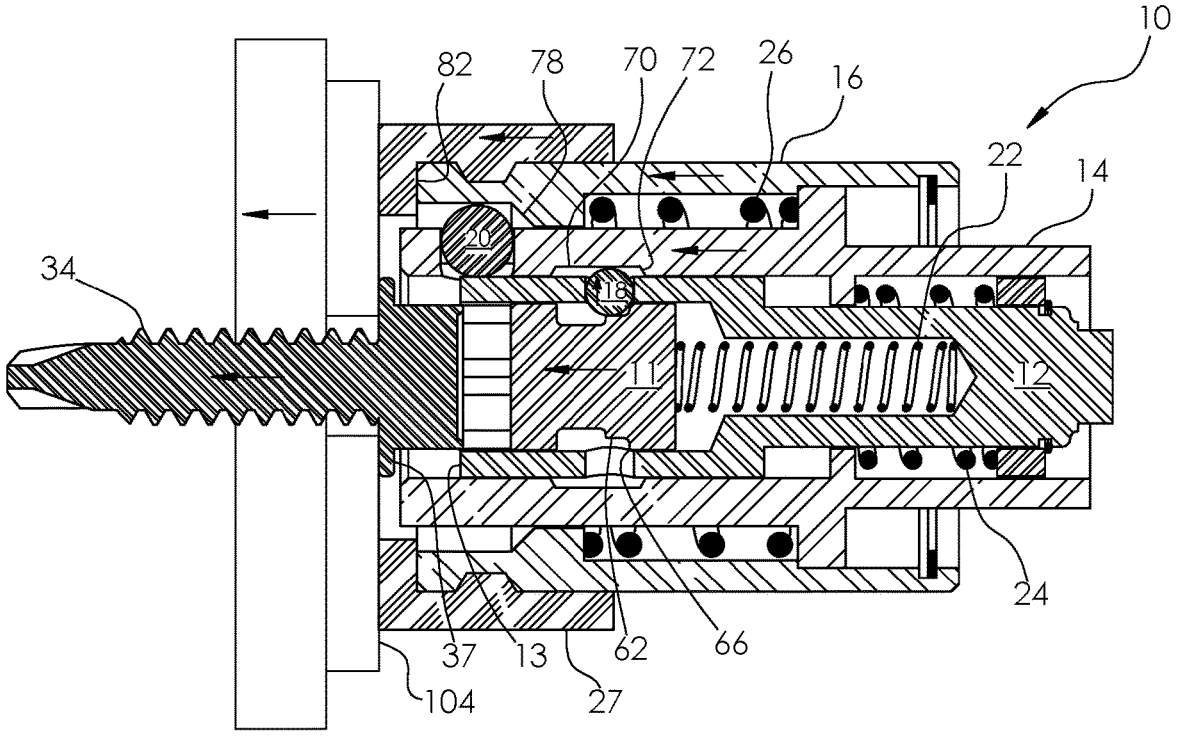
FIG. 6 is a section view of a first embodiment where a fastener has been entirely installed in a workpiece and the device has been partially retracted from the work surface.

FIG. 6 is a cross-sectional view of a first embodiment where a fastener has been entirely installed in a workpiece and device 10 has been partially retracted from the work surface 104. Arrows have been superimposed on various bodies to indicate the direction they have moved since the preceding state illustrated in FIG. 5, where for purpose of illustration bit 12 is assumed to be the fixed reference frame.

A gap now exists between the top washer surface 37 of fastener 34 and the distal face 13 of bit 12. Trigger shuttle 11 is no longer in contact with the head of fastener 34 so that spring 22 has pushed shuttle 11 forward to the point that ball 18 has been pushed radially outward into internal groove 70 by section 62 of shuttle 11, and the forward position of shuttle 11 is limited by ball 18 bearing against shoulder 66.

Further retraction of device 10 away from work surface 104 will cause sleeve 14 to slide further forward relative to bit 12 under the force of spring 24 until shoulder 72 contacts ball 18, which will then limit the forward position of sleeve 14 relative to bit 12. Still further retraction of device 10 from work surface 104 will cause sleeve 16 to slide forward relative to sleeve 14 under the force of spring 26 until shoulder 78 contacts balls 20, which thus will limit the forward position of sleeve 16 relative to sleeve 14.

Further retraction of device 10 will cause bumper 27 to lose contact with work surface 104. At that point, device 10 will be ready for loading of a subsequent fastener without requiring any direct manipulation. Bumper 27 is designed to prevent contact between face 82 of sleeve 16 or the distal face of sleeve 14 with work surface 104 to minimize marring concerns that may otherwise be present. Bumper 27 may be a soft polymer, elastomer, or rubber. It may also be replaced by a thrust bearing which could take many conventional forms including, but not limited to, a plain thrust bearing of low-friction plastic or a thrust bearing assembly containing roller elements, such as spherical balls with a soft material being applied on the distal external face of such a bearing assembly.

Figure 7:
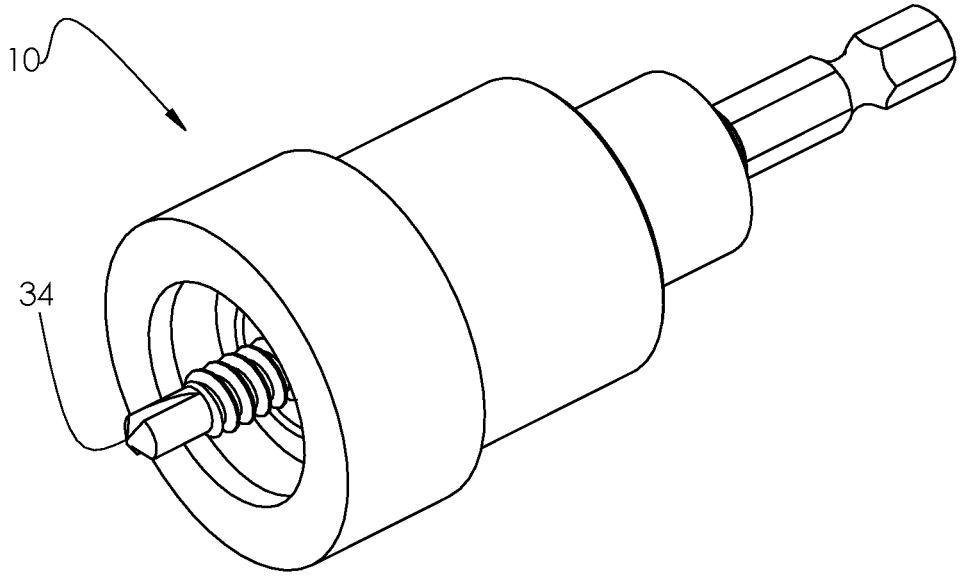
FIG. 7 is an isometric view of a first embodiment with a fastener loaded.

FIG. 7 is an isometric view of a first embodiment with a fastener 34 loaded into device 10. Note that this is the same mechanical state or configuration as detailed in FIG. 1 and FIG. 4.

Note that while a hex washer head fastener is shown in these figures, this design was chosen as a particularly challenging type of application. The present invention may be utilized for fasteners of other external drive geometries including, but not limited to, square, hexagon or six-lobular with or without a washer head by making simple modifications to the shape of current components. For example, a separate hexagonal nut and a flat round washer could be retained together into device 10 with the mechanisms as illustrated. Loading of such individual fasteners may benefit from utilizing a fixture to stage a nut and washer pair prior to loading for productivity.

Figure 8:
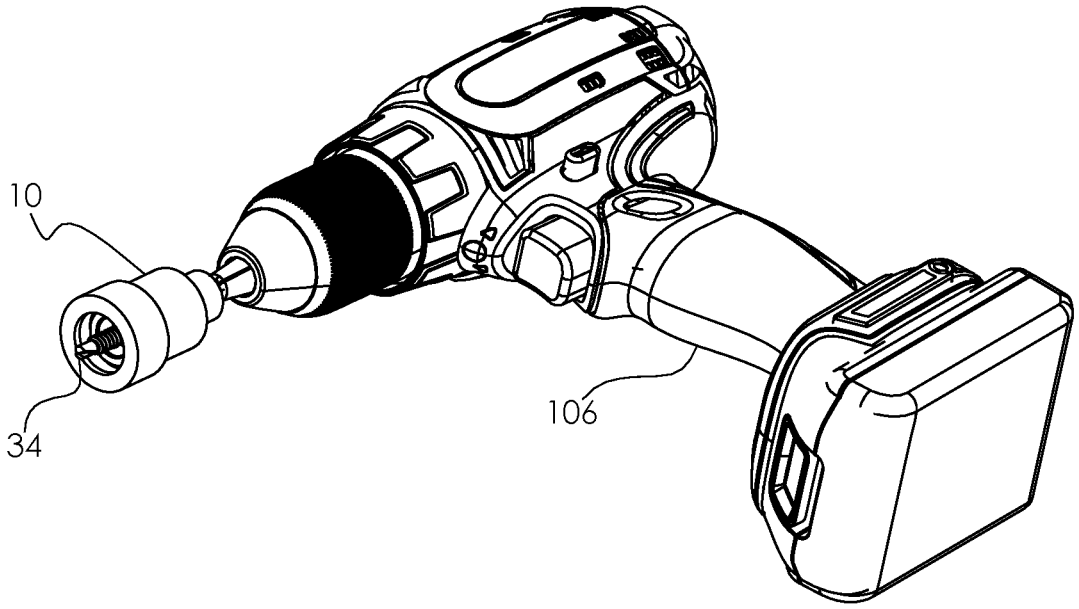
FIG. 8 is an isometric view of a first embodiment installed in a power drill.

FIG. 8 is an isometric view of a first embodiment installed in a power drill. Device 10 is shown installed into the chuck of a power drill 106. A fastener 34 has been installed in device 10 where device 10 would be in the state illustrated by FIG. 4.

It should be understood that the power drill 106 is only one example of a source of rotary power. Other examples are a ratcheted or non-ratcheted screw driver handle, configured to be grasped and turned by a human hand, and having an interface for receiving and retaining a drill bit, screw driver tip insert or other shaft. Still another example of a source of rotary power could be a ratcheted or non-ratcheted wrench or the like or any suitable substitute.

Figure 9:
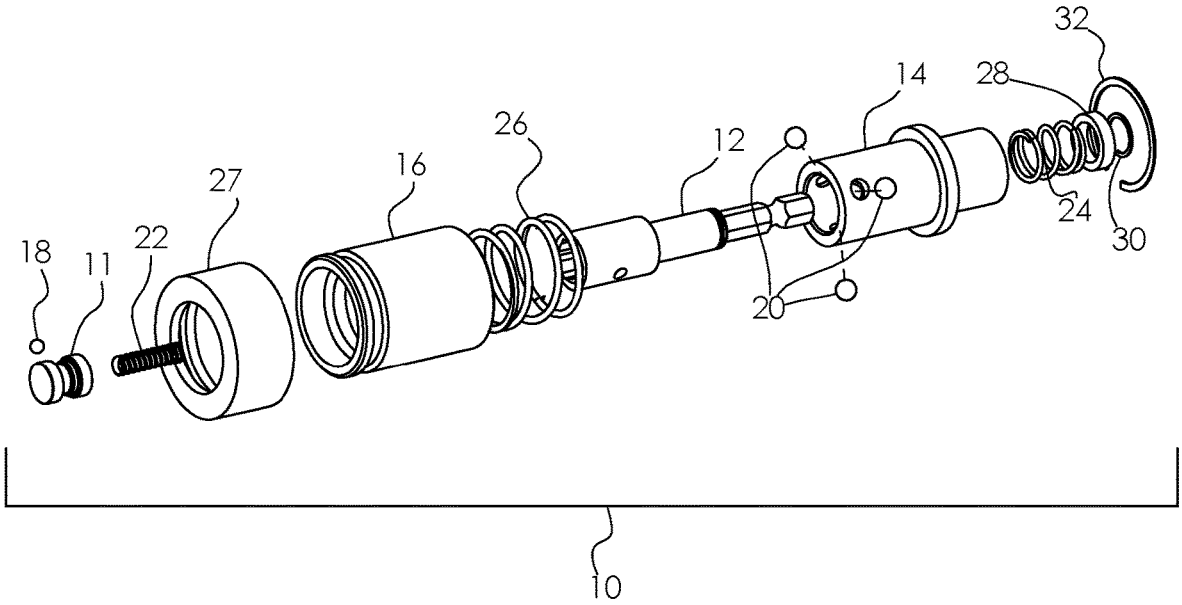
FIG. 9 is an exploded isometric view of a first embodiment.

FIG. 9 is an exploded isometric view of a first embodiment. The device for retaining and driving fasteners of the first embodiment is illustrated generally as 10. The assembly includes a trigger shuttle 11, a driving bit 12, a carrier sleeve 14, a cam sleeve 16, a trigger ball 18, a plurality of radially spaced retention balls 20, a trigger shuttle spring 22, a carrier sleeve spring 24, a cam sleeve spring 26, a washer 28, a retaining device 30, and a retaining device 32. A scratch resistant bumper 27 is optionally included.

Following the illustrations of FIGS. 2 through 9, the following describes the method of installing two fasteners utilizing the illustrated embodiment. For purpose of this illustrative sequence, the entire device 10 is assumed to be installed in a powered drill via shank 36. The device will generally be configured in the state shown in FIG. 2, where it is ready for a fastener to be loaded. A user may hold a powered driver in one hand with device 10 installed and then pick up a fastener 34 with a second hand, grasping it near the end opposite of the head. The user can then push the fastener 34 into device 10, using tactile feedback to assist with aligning the drive geometry on fastener 34 with the drive geometry of the bit 12. FIG. 3 shows a fastener 34 pushed part way into device 10 where trigger shuttle 11 has been pushed somewhat rearward, device 10 being on the verge of releasing stored spring energy with slightly further rearward travel of shuttle 11, which will serve to slide a carrier sleeve 14 forward.

FIG. 4 shows the device just a moment later after fastener 34 was pushed in slightly further, pushing shuttle 11 rearward which in turn allows ball 18 to move radially inward thus beginning the triggering action of the device to position the carrier sleeve 14 forward, subsequently allowing outer cam sleeve 16 to push retention balls 20 radially inward while cam sleeve 16 moves forward relative to carrier sleeve 14, thereby establishing a secure retention of the fastener. The user never needed to touch device 10 directly throughout the loading process, they only needed to push the fastener in.

At this point, device 10 can then be used to install fastener 34 into a work surface while holding the fastener with significant retention force, which is an object of the present invention. A user will begin to install the fastener and after the amount of the fastener shown protruding out of the device in FIG. 4 has been installed, device 10 will contact the work surface and cam sleeve 16 will begin to retract relative to fastener 34. FIG. 5 shows device 10 and fastener 34 in a state where fastener 34 has been partially installed into a workpiece. Cam sleeve 16 has been retracted due to contact with a work surface. The current position of cam sleeve 16, in turn, allows retention balls 20 to move radially outward if so urged. No further restrictions will impede forward motion of fastener 34 or bit 12 to fully complete the installation of the fastener. After the fastener is fully installed, a user may freely pull the powered drill and thus device 10 away from the work surface. FIG. 6 shows device 10 after the user has pulled slightly away from the work surface.

After additional motion away from the work surface, the jaw sleeve 14 and cam sleeve 16 will both be able to travel forward an additional amount until they reach the state which is shown in FIG. 2. Note that the user did not need to directly touch device 10 at any point when installing fastener 34. At that point, with device 10 again in the state shown by FIG. 2, it is configured to freely receive another fastener. Without setting the drill down, a user may pick up a subsequent fastener and push it into device 10, whereby the state of FIG. 3 will quickly be passed through and the device will rest at the state of FIG. 4 ready to install a fastener. The user can then install the second fastener 34 into a work surface at which the point of partial installation shown by FIG. 5 will be passed through on the way to full installation of the fastener. The user can then pull the drill and thus device 10 away from the work surface, during which the device will pass through the state shown in FIG. 6, then reaching the state of FIG. 2 as the device loses contact with the work surface. Thus the sequence of fastener installation into device 10, installation of a fastener 34, and retraction from the work surface may happen in multiple repeated cycles without requiring a user to directly manipulate device 10.

Figure 10:
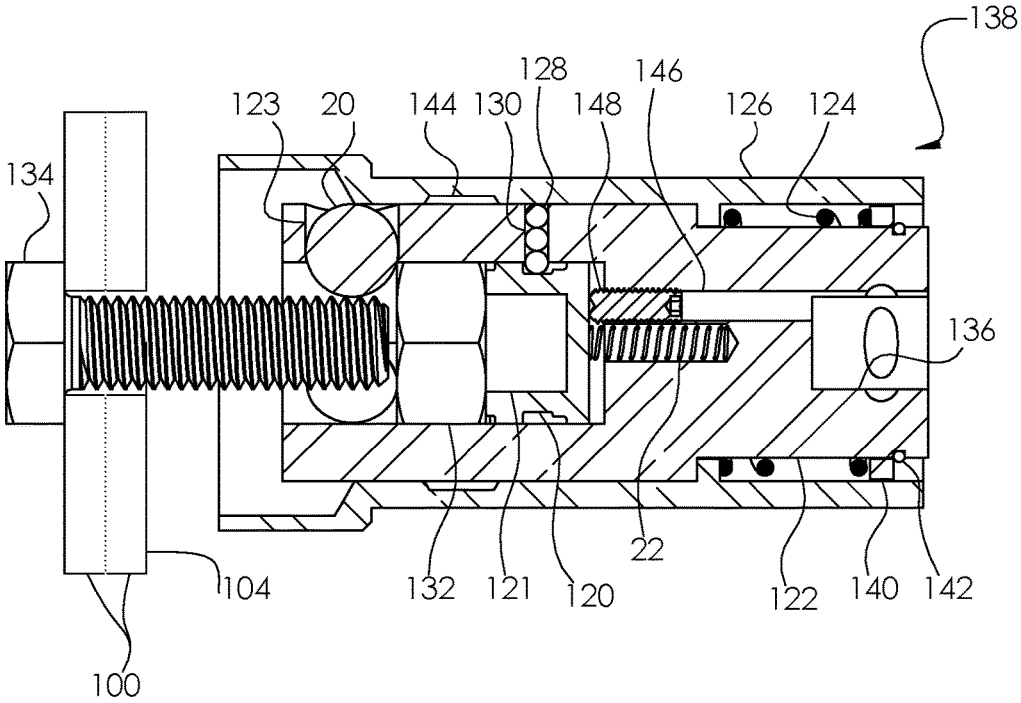
FIG. 10 is a section view of a second embodiment of the present invention.

FIG. 10 is a section view of a second embodiment of the present invention illustrated generally as 138. Device 138 includes a drive bit 122 having a plurality of radial passages 123 which contain retention balls 20. This approach is in contrast to the first embodiment where the balls were included in ball carrier sleeve (14 in prior figures) which is not contained in the second embodiment illustrated here. Passages 123 are shaped so as to prevent the complete passage of balls 20 fully through and past the inner surface of bit 122. A stack of three trigger balls 128 communicate with radial bore 130 in bit 122.

In this case, a plurality of balls allows for a more sensitive triggering position and reduced longitudinal size of the assembly as compared to using one much larger ball. Trigger balls 128 communicate with trigger shuttle 120 in a similar manner as the first embodiment; however shuttle 120 now includes a central bore 121 for clearance of a mating fastener 134. Compression spring 22 reacts between trigger shuttle 120 and drive bit 122. Spring 124 reacts between an outer cam sleeve 126 and drive bit 122 with assistance from washer 140 and retaining device 142.

The interaction by a user or mechanism to utilize device 138 will utilize similar steps as the operation of device 10 as previously described. In this figure, a nut 132 shown here as a hex nut has been loaded into device 138, which is illustrated in the loaded configuration. Balls 20 are sized such that in the loaded configuration, they will closely approach the shank of fastener 134 which is to be assembled to nut 132. The close proximity of balls 20 and the shank of fastener 134 will assist in aligning said shank with device 138 and thus fastener 132. If the shank of fastener 134 is centered between balls 20, when the distal tip of said shank is engaged with nut 132, the axis of the two fasteners will be largely parallel and coaxial, thus the assembly sequence can proceed rapidly without a concern for cross threading between fasteners 134 and 132.

Fastener 134 is shown protruding through workpieces 100, including a work surface 104 closest to device 138. While not shown, it is assumed that appropriate tools are used to maintain the position and resist rotation of fastener 134 while fastener 132 is installed. During operation of device 138, sleeve 126 will contact work surface 104 and the fastener 132 will be released by balls 20 to allow full and complete installation without direct manipulation of device 138. Device 138 will be automatically configured into an open position after installation of a first fastener 132 by the outer most of trigger detent balls 128 protruding into the internal circumferential groove 144 in sleeve 126. A subsequent fastener 132 can then be loaded without direct manipulation upon device 138 from a user or outside mechanism. Balls 20 float freely and thus will be pushed radially outward by said fastener during loading. Device 138 includes a bore 136 on its proximal end for engagement with a driving device or tool (not shown), bore 136 in this case being illustrated as a square depression though a myriad of engagement methods could be used. Device 138 includes a longitudinal threaded bore 146, which receives a set screw 148, which is used to adjust and limit the rearward extreme position of trigger shuttle 120, thereby allowing device 138 to be adjusted for a fastener 132 that may have a range of lengths, yet still maintaining fastener 132 very close to, or in contact with, balls 20 and the mechanical retaining properties of that arrangement.

An illustrative sequential operation of this second embodiment shown in FIG. 10 could proceed as follows. A user would connect device 138 to a driving tool, perhaps a powered drill with a square socket adapter in the chuck as an illustrative example. The user can then ensure the device is in the proper state to receive a fastener by pressing outer sleeve 126 against their hand perhaps. If not already in a state to receive a fastener, this action will configure device 138 into such a state which is akin to the state of the first embodiment illustrated in FIG. 2. The user, then holding the drill in one hand will load a fastener 132 with a second hand by first aligning fastener 132 with a geometric shape, such as a hex cut into the central bore of device 138. Once aligned, the user can push the fastener, here shown as a nut rearward into the device, perhaps pushing the fastener down into the device with a finger tip.

During this loading sequence, fastener 132 will contact trigger shuttle 120 and push it rearward in device 138, at some rearward position allowing trigger balls 128 to travel radially inward thus allowing stored energy in spring 124 to be released to push sleeve 126 forward relative to drive bit 122. The user may then install a mating fastener, such as bolt 134 through holes in two work pieces 100 and hold that fastener with conventional means such as a box end wrench (not shown). The user could then approach fastener 134 with device 138 which is holding fastener 132 and then turn on the rotation of the drill. Even without precise alignment, balls 20 will serve to align device 138 and fastener 132 with fastener 134 such that the risk of cross threading engagement between fasteners 132 and 134 is greatly reduced.

By proceeding forward with the drill spinning, the threads of fasteners 132 and 134 will engage and thread upon each other, pulling device 138 toward work surface 104. As the front face of sleeve 126 contacts surface 104, further progression of the tool forward while progressing the fasteners together will retract sleeve 126 relative to drive bit 122, thus allowing balls 20 to travel radially outward, removing mechanical obstructions upon fastener 132. Fastener 132 will be drawn fully out of drive bit 122 for a continuous and complete installation of the fastener since the front bore of bit 122 has substantially the geometric profile to accommodate torque transmission to fastener 132 all the way to its front face. After the user installs fastener 132 upon fastener 134, they can retract device 138 away from surface 104 and device 138 will be left in an open state to receive a subsequent fastener 132, without needing to directly manipulate or even contact device 138 in any fashion. The user will simply align and push in another fastener 132 and install it upon a subsequent fastener 134. This cycle can continue in subsequent cycles of loading, installation, and retraction of the tool from the work surface without requiring that the operator directly touch device 138 to directly manipulate any components.

The process of fastener installation and retraction of tool 138 from surface 104 are generally akin to the stages illustrated in FIGS. 5 and 6 for the first embodiment.

A third embodiment of the invention could modify the mechanics of device 138 shown in FIG. 10 to utilize smaller balls 20 thereby reducing the length and diameter of such a device whereby significantly increasing radial clearance between the shank of mating fastener 134 and balls 20. This will reduce somewhat the ability of device 138 to engage and align the two mating fasteners 134 and 132, but the many previously mentioned advantages to the current invention would be retained.

Figure 11:
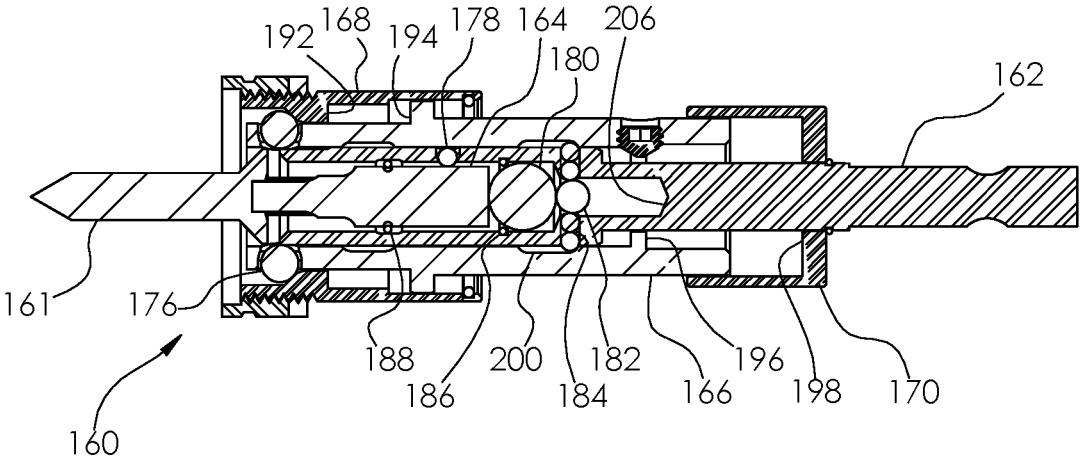
FIG. 11 is a section view of a fourth embodiment illustrated with a fastener containing a geometric drive depression in an unloaded state.

FIG. 11 is a section view of a fourth embodiment for fasteners containing geometric drive depressions, generally illustrated as device 160, which is shown here in in an unloaded state. Device 160 includes a fastener 161, a bit holder 162, and a bit insert 164 which will include drive geometry to interface with a fastener such as a cruciform, straight blade, hexagon, hex-lobular, or square drive. Bit insert 164 has a circumferential groove in which a retaining ring 188 will retain the bit insert 164 within bit holder 162 under normal operating conditions, but will also allow removal to change to an alternate bit insert 164. Located within bit holder 162 is a spacer ball 180, intermediate ball 182 and a plurality of trigger balls 184. A compression spring (not shown) will react between bore face 206 and ball 182 to urge ball 182 and subsequently ball 180 and bit insert 164 forward towards the fastener receiving end of device 160. Sleeve 166 contains an internal groove 200 for interacting with trigger balls 184 for controlling the operational states and the triggering of device 160 between those states.

A retaining ring 186 can limit the forward travel of spacer ball 180 and thus retain ball 180 even if bit insert 164 is removed. A spring (not shown) will react between face 196 of sleeve 166 and face 198 of spring retaining sleeve 170 to urge sleeve 166 forward relative to bit holder 162. A third spring (not shown) will react between faces 192 and 194 to urge cam sleeve 168 forward relative to sleeve 166. A plurality of clutch balls 178 are disposed in radial bores in bit holder 162 to control the transmission of torque between bit holder 162 and bit insert 164. In this figure, fastener retention balls 176 are retracted radially outward so a fastener 161 can be loaded without obstruction.

Figure 12:
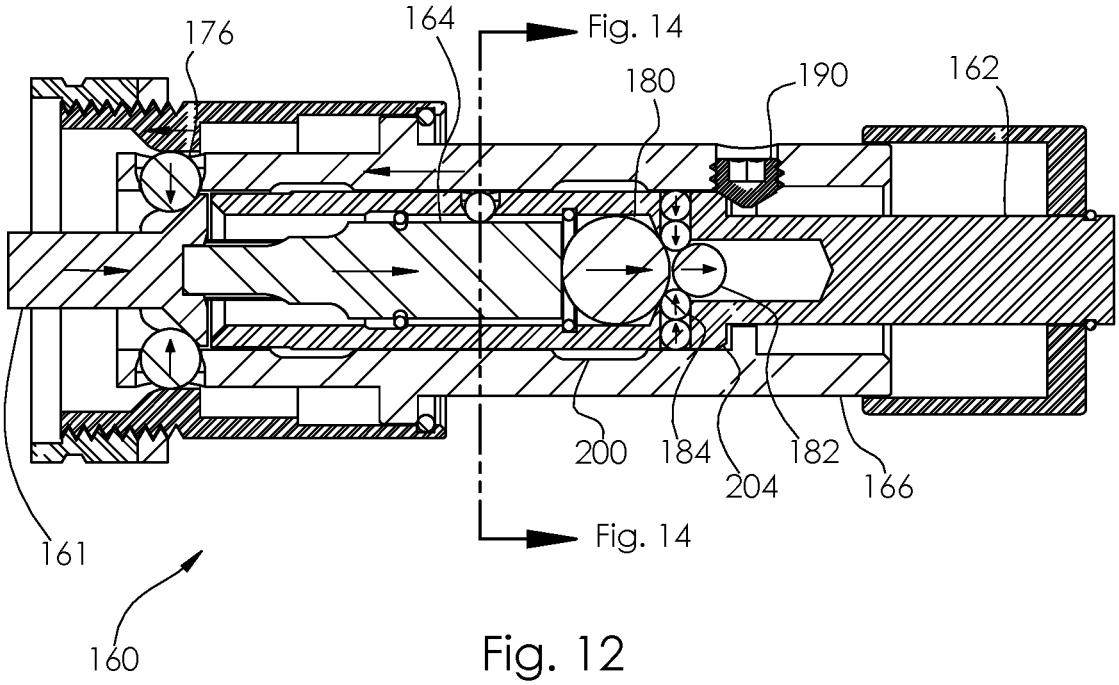
FIG. 12 is a section view of a fourth embodiment illustrated with a fastener containing a geometric drive depression in a loaded state, ready to be installed.

FIG. 12 is a section view of a fourth embodiment illustrated with a fastener containing a geometric drive depression in a loaded state, ready to be installed. Arrows have been superimposed to various bodies to indicate the direction they have moved since being in the state illustrated in FIG. 11, where for purpose of illustration bit 162 is assumed to be the fixed reference frame. By fastener 161 being pushed into device 160, the train of bit insert 164, ball 180, and ball 182, have moved rearward and balls 184 have moved radially inward to clear internal groove 200 and allow sleeve 166 to travel forward, the forward position of which is limited by a set screw 190 contacting shoulder 204 of bit holder 162. Note that the tapered point of set screw 190 allows for adjustment of the forwardmost position of sleeve 166 relative to bit holder 162, which will allow for device 160 to be adjusted to accommodate a range of fastener head geometries (head diameter, shape, thickness etc.) for appropriate fastener holding. With balls 176 then being able to move radially inward, sleeve 168 has caused such movement while being pushed forward by the spring acting on it. Fastener 161 is thus retained by balls 176 and is ready to be installed.

Figure 13:
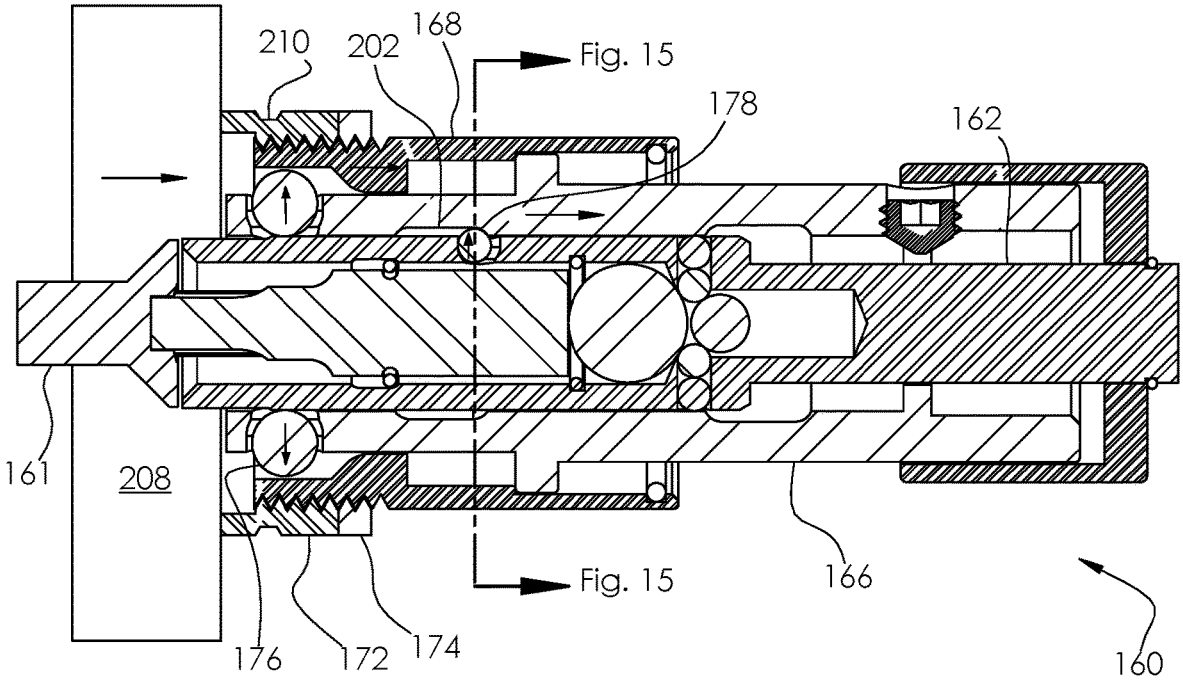
FIG. 13 is a section view of a fourth embodiment with a fastener that has been installed to the point an optional clutch mechanism has disengaged torque transmission to the fastener.

FIG. 13 is a section view of a fourth embodiment with a fastener that has been installed to the point an optional clutch mechanism has disengaged torque transmission to the fastener. Arrows have been superimposed to various bodies to indicate the direction they have moved since being in the state illustrated in FIG. 12, where for purpose of illustration, bit holder 162 is assumed to be the fixed reference frame. It can be seen that adjustable ring 172 is in contact with the face of a workpiece 208 to where sleeve 168 has been retracted to its extreme rearward position relative to sleeve 166 given a stepped diameter inside sleeve 168 contacting the outer collar of sleeve 166, thus allowing balls 176 to be displaced radially outward by fastener 161 and bit holder 162. Sleeve 166 has in turn been retracted rearward relative to bit holder 162 until the point where a plurality of clutch balls 178 are able to move radially outward into internal groove 202 in sleeve 166. At this point, bit insert 164 with a largely hexagonal cross section is able to rotate freely relative to bit holder 162.

This disengagement of torque transmission means serves to control the driving depth of fastener 161 to a desired and repeatable depth. The depth of installation for fastener 161 may be adjusted by moving adjustable ring 172 forward or rearward on sleeve 168. A jam nut 174 is provided for locking the position of ring 172. When device 160 is retracted from workpiece 208, it will be configured so as to receive a subsequent fastener without direct manipulation. Adjustable ring 172 has a circumferential groove 210 for receipt of an optional scratch resistant bumper as discussed previously.

Figure 14:
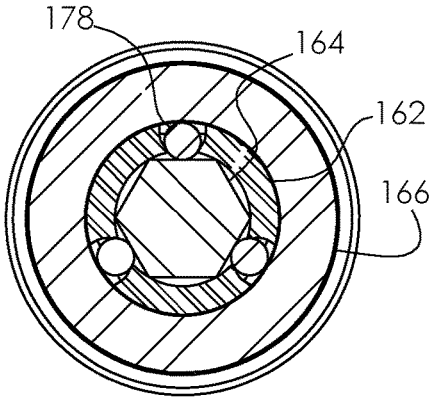
FIG. 14 is a section view of a fourth embodiment at the state illustrated in FIG. 12 illustrating the clutch mechanism in a torque transmitting state.
Figure 15:
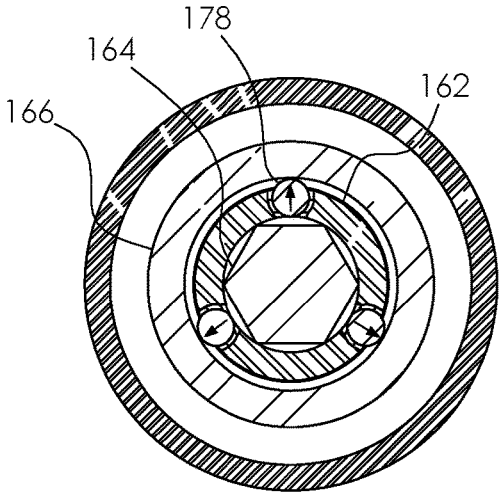
FIG. 15 is a section view of a fourth embodiment at the state illustrated in FIG. 13 illustrating the clutch mechanism in a non-torque transmitting state.

FIGS. 14 and 15 are section views of device 160 illustrating the states shown in FIG. 12 (clutch mechanism transmitting torque) and FIG. 13 (clutch not transmitting torque) respectively. The longitudinal position of sleeve 166 relative to clutch balls 178 will control the transmission of torque between bit holder 162 and bit insert 164. This is due to internal groove 202 allowing clutch balls 178 to travel radially outward to eliminate the obstruction they cause for bit insert 164 which otherwise prevents free relative rotation by engaging with the hexagonal cross section of bit insert 164.

An illustrative sequential operation of the fourth embodiment shown in FIGS. 11 through 15 could proceed as follows. A user will install device 160 into a power drill (not shown) by tightening shank 162 into the drill of said drill. The user can then ensure the device is in the proper state to receive a fastener by pressing the fastener receiving end of device 160 against their hand. If not already in a state to receive a fastener, this action will configure device 160 into such a state, as is shown in FIG. 11. Then, while holding the drill in one hand they will grab a screw 161 with their second hand and twirl screw 161 slightly while screw 161 is applying light pressure upon bit insert 164 in order to align the drive geometry of screw 161 and bit insert 164.

Once the drive geometry is aligned, the user can then push the screw rearward, in turn pushing bit insert 164 rearward and eventually triggering a release of stored energy as has been described previously in multiple embodiments. This release of energy will position sleeve 166 forward, carrying with it retention balls 176 which will then serve to retain the head of screw 161 into device 160 by mechanically obstructing the removal of screw 161 from device 160. The state of screw 161 being captured in device 160 is illustrated in FIG. 12. Screw 161 can then be fully installed into a work piece without any direct contact with or manipulation of device 160 by a user. A unique feature of the fourth embodiment, which is not present in the prior embodiments, is an automatic clutch mechanism which will disengage torque transmission from the drill to the screw to limit the depth at which it is countersunk. Therefore a user is not required to precisely time when they need to stop the drill from spinning.

The process of this clutch disengagement is illustrated in the preceding discussion of FIGS. 12-15. A cross section of device 160, screw 161, and a work surface 208 at the point where the clutch mechanism has disengaged to stop torque transmission from the drill to the screw is illustrated in FIG. 13. At the point the user has driven a screw to the point that the clutch has disengaged torque transmission between the drill and screw 161, they are able to pull device 160 away from work piece 208 and device 160 will be configured to receive a subsequent screw 161 without requiring the user to directly touch or manipulate device 160. The user can then pick up a subsequent screw 161 and twirl it slightly to align the drive geometries of screw 161 and bit insert 164 and then pushing screw 161 rearward into the device such that device 160 will trigger the release of stored energy where components are repositioned to retain screw 161 with mechanical obstruction to prevent unintentional dropping of the screw while installing.

The user can keep the power switch of the drill pressed in until the clutch mechanism within device 160 disengages torque transmission between the drill and screw 161. At that point, they can again pull device 160 away from work piece 208 and load a subsequent screw 161 with this cycle continuing as much as needed.

Further analyzing FIG. 4, while there are benefits achieved by having internal collar 76 pass over the retention balls 20 such that the collar 76 contacts the top center of balls 20 outward radial forces applied to said balls by a fastener do not impart longitudinal positioning force onto sleeve 16, collar 76 need not pass fully past the balls 20 but rather shoulder 78 alone may push on balls 20, perhaps multiplying the force applied by spring 26 through a mechanical advantage of such an orientation would not deviate from the scope and spirit of the present invention. Modifications to the profile of shoulder 78 as illustrated can be made to alter the mechanical advantage realized by the spring to retain fasteners, such as modifying the slope tangent of the profile of shoulder 78 at various points to be disposed at a smaller angle from the tool's central axis. Some of these modifications are illustrated in FIGS. 11 through 13. Note that such modifications can allow for greater variations in fastener geometry to be tolerated while holding a fastener in a specific position at the cost of potentially reduced retention force.

FIGS. 11-13 illustrate adjustability between sleeve 166 and a bit holder 162 utilizing a set screw with a tapered point, but various options could achieve a similar result. As a couple examples, on the figures detailing device 10, adjustment mechanisms could be added to provide adjustability for the forward extreme position of sleeve 14 relative to bit 12, such as internal collar 71 being separate from yet threadably adjustable within the bore of sleeve 14. A resilient member may be disposed between bit 12 and sleeve 14 to provide some urging force would serve a similar purpose.

The present invention can be characterized as a system for advancing a fastener which includes a means for engaging a fastener head and causing the fastener head to be subjected to forces which cause the fastener head to rotate; a means for storing energy by installing a fastener into a workpiece; a means for mechanically obstructing disengagement of the fastener from the means for engaging, by releasing stored energy from said means for storing energy; and a means for interfacing a source of rotary power, so as to provide for an ability to rotate said means for engaging. It should be understood that the means for interfacing a source of rotary power may include an integral clutch mechanism to disengage transmission of rotary power from the source of rotary power to the fastener thereby controlling the driven depth of fastener into the work piece.

As one illustrative example of alternative constructions, the details of the fastener retaining elements are illustrated as spherical elements in the figures of this application; however they could be replaced by elements of other shapes without departing from the scope of the device and method claimed. The pinching fingers discussed above in the fourth category of prior art could be integrated into the device as claimed to replace the ball bearings illustrated in the figures of the present invention without departing from the spirit of the invention.

As an example, elements similar to those labeled 150 and 151 in U.S. Pat. No. 6,244,141 could be integrated into an alternative embodiment of the devices illustrated in the present invention where, for example, these alternative components would be positioned by a sleeve of structure similar to 14 in the detailed description of the present invention and they would be urged radially inward by a cam sleeve of structure similar to 16 in this same description.

Another alternate embodiment could integrate the collet arrangement illustrated in U.S. Pat. No. 6,497,166 into similar structures as said carrier sleeve 14, and urged inward by similar structures as said cam sleeve 16 where 14 and 16 are illustrated in the figures of the present invention.

It is thought that the method and apparatus of the present invention will be understood from the foregoing description, and that it will be apparent that various changes may be made in the form, construct steps, and arrangement of the parts and steps thereof, without departing from the spirit and scope of the invention, or sacrificing all of their material advantages. The form herein described is merely a preferred exemplary embodiment thereof.

I claim:

1. A method of installing fasteners comprising:

engaging a member with a portion of a first fastener;

mechanically obstructing disengagement of the first fastener from said member;

storing energy collected by installing the first fastener into a workpiece;

disengaging the first fastener from said member; and upon engagement of a second fastener with said member, triggering a release of said energy collected by installing the first fastener into the workpiece.

2. The method of claim 1 wherein said energy is a sole source of energy to mechanically obstruct disengagement of said second fastener from said member.

3. The method of claim 2 wherein said triggering a release of said energy is an automatic triggering caused by interaction between said second fastener and said member.

4. The method of claim 1 wherein said step of engaging comprises engaging a bit insert configured to mate with a fastener head void.

5. The method of claim 1 wherein said step of engaging a member comprises the steps of:

a. providing a fastener driver device with a central longitudinal axis, said fastener driver device comprising;

i. an outer cam sleeve in an outer cam sleeve stored energy position;

ii. a bit, disposed, at least in part, within said outer cam sleeve;

iii. a trigger structure, disposed within said bit;

iv. a first spring disposed between said trigger structure and said bit; and v. a second spring disposed between said bit and said outer cam sleeve; and b. providing a source of power to a shank portion of said bit.

6. The method of claim 5 wherein said step of mechanically obstructing disengagement of the first fastener from said member comprises the steps of:

a. coupling a first fastener into said fastener driver device by:

i. causing relative motion of said first fastener into said fastener driver device beyond a point where stored spring energy within said fastener driver device causes said outer cam sleeve to slide forward, which allows said outer cam sleeve to push a retention ball radially inward; and ii. causing a mechanical obstruction to removal of said first fastener from said fastener driver device by engaging said retention ball with a portion of said first fastener.

7. The method of claim 6 wherein said step of storing energy collected by installing the first fastener into a workpiece comprises the steps of:

a. advancing the first fastener into a work piece using said source of power;

b. said outer cam sleeve causing a contact with said work piece into which said first fastener is being advanced thereby creating relative movement between said outer cam sleeve and said first fastener; and c. pulling said fastener driver device away from said work piece and allowing access to said trigger structure while said outer cam sleeve is in said outer cam sleeve stored energy position.

8. The method of claim 7 wherein said step of: upon engagement of a second fastener with said member, triggering a release of said energy collected by installing the first fastener into the workpiece, comprises the steps of:

a. after said first fastener is free of any coupling to said fastener driver device, coupling a second fastener into said fastener driver device by:

i. causing relative motion of said second fastener into said fastener driver device beyond a point where stored spring energy within said fastener driver device causes said outer cam sleeve to push said retention ball radially inward; and ii. mechanically obstructing removal of said second fastener from said fastener driver device by engaging said retention ball with a portion of said second fastener; and b. advancing the second fastener into a work piece using said source of power.

9. The method of claim 1 further comprising the step of adjusting a forward most position of a mechanical obstruction relative to said member.

10. The method of claim 1 further comprising the steps of engaging a previously installed fastener and moving said previously installed fastener away from said workpiece where a mechanical obstruction to disengagement is automatically deployed.

* * * * *